US006812390B2

(12) United States Patent
Kalbas

(10) Patent No.: US 6,812,390 B2
(45) Date of Patent: Nov. 2, 2004

(54) VIOLIN STAND

(76) Inventor: John E. Kalbas, 312 Friendship Rd., Paige, TX (US) 78659

( * ) Notice: Subject to any disclaimer, the term of this patent is extended or adjusted under 35 U.S.C. 154(b) by 108 days.

(21) Appl. No.: 10/358,167

(22) Filed: Feb. 5, 2003

(65) Prior Publication Data

US 2004/0149119 A1 Aug. 5, 2004

(51) Int. Cl.[7] ..... G10D 3/00
(52) U.S. Cl. ..... 84/327; 84/421; 84/329; 84/453
(58) Field of Search ..... 84/327, 421, 329, 84/453

(56) References Cited

U.S. PATENT DOCUMENTS 2,547,924 A * 4/1951 Citro ..... 84/327
2,630,289 A * 3/1953 Selig ..... 248/169
4,742,751 A 5/1988 Cherry ..... 84/327
5,202,527 A * 4/1993 Gracie ..... 84/327
5,297,771 A * 3/1994 Gilbert ..... 248/688
5,488,890 A 2/1996 Biasini ..... 84/280
5,852,250 A 12/1998 Cha ..... 84/327
5,986,193 A * 11/1999 Garrison ..... 84/327
6,281,417 B1 8/2001 Ladao ..... 84/327

FOREIGN PATENT DOCUMENTS

CH 677043 3/1991

* cited by examiner

*Primary Examiner*—Shih-Yung Hsieh
(74) *Attorney, Agent, or Firm*—Stephen R. Greiner

(57) ABSTRACT

A violin stand including a support plate with at least one hole and at least one slot remote from said hole. A number of threaded rods extend through each hole and each slot and project from the front and the back of the support plate. A number of nuts extend from the back of the support plate with one of the nuts being threadably fastened to each of the threaded rods. A number of pegs extend from the front of the support plate. One of the pegs is affixed to each of the threaded rods in an off-centered manner such that the pegs act like cams when rotated with the threaded rods.

5 Claims, 1 Drawing Sheet

VIOLIN STAND

FIELD OF THE INVENTION

The present invention relates generally to supports for stringed musical instruments.

BACKGROUND OF THE INVENTION

It has always been difficult for violinists to put down their instruments for brief periods of rest during a musical performance. Because of their fragile nature and abundance of curved surfaces, violins cannot safely be set on the floor or easily propped up against a support like more robust instruments. Instead, violinists who want to prolong the lives of their instruments usually place their instruments back in their cases when not in use to prevent damage. Unfortunately, it can be inconvenient to repeatedly store and retrieve a violin from its case.

SUMMARY OF THE INVENTION

In light of the problems associated with securing a violin during periods where the use of a violin case is inconvenient or impractical, it is the principal object of the invention to provide a stand capable of holding a violin in a convenient position for ready access and play by a user. The stand holds a violin snugly, yet releasably, and will not mar the instrument.

It is another object of the present invention to provide a violin stand of the type described that is adjustable to accommodate violins having different dimensions. Adjustment of the violin stand can be accomplished without tools or prolonged periods of instruction. In fact, it is believed that use of the violin stand would be intuitive for most users.

It is an additional object of the present invention to provide a violin stand of the type described that will also support a violin bow for ready access by a user. The bow can be supported by the stand upon either side of a violin to accommodate right- or left-handed users.

It is a further object of the invention to provide a violin stand that can be easily disassembled. In its disassembled state, the component parts can be conveniently transported or stored in an out of the way place. If desired, the upper, clamping portion of the stand can be positioned on a table to firmly support a violin in a horizontal position for adjustment or repair.

It is an object of the invention to provide improved elements and arrangements thereof in a violin stand for the purposes described which is lightweight in construction, inexpensive to manufacture, and dependable in use.

Briefly, the violin stand in accordance with this invention achieves the intended objects by featuring a ground-engaging base and a post extending upwardly from the base. A support plate is mounted atop the post. The support plate includes a pair of holes and a pair of adjacent slots. One of a number of threaded rods extends through each of the holes and each of the slots. A number of pegs extend forwardly from the support plate with one of the pegs being affixed to each of the threaded rods in an off-centered manner such that the pegs act as cams when rotated with the threaded rods. A number of nuts extend rearwardly from the support plate with one of the nuts being threadably fastened to each of the threaded rods.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 2:
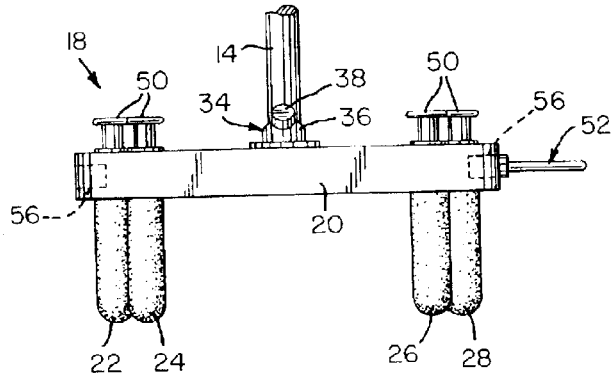
FIG. 2 is a top view of the clamping portion of the violin stand of FIG. 1.

Referring now to the FIGS., a violin stand in accordance with the present invention is shown at 10. Violin stand 10 includes a lower, supporting portion 12 having a post 14 extending upwardly from a ground-engaging base 16. Mounted atop post 14 is an upper, clamping portion 18 with a support plate 20 from which four pegs 22, 24, 26 and 28 extend forwardly to engage the narrowed, center bout 30 of a violin 32.

A mounting bracket 34 is affixed to the back of support plate 20 to facilitate the attachment of support plate 20 to post 14. Bracket 34 has a tubular sleeve 36 that receives the top of post 14. The longitudinal axis of sleeve 36 is oriented about 45 degrees to the back of support plate 20 so that, in use, the parallel front of plate 20 cants upwardly and rearwardly to support violin 32 at an incline. (This incline presents violin 32 to a user at a comfortable attitude and, also, discourages the separation of violin 32 from pegs 22–28 in the event that stand 10 is inadvertently bumped.) A thumbscrew 38 penetrates sleeve 36 to releasably lock bracket 34 upon post 14.

Support plate 20 is provided with openings on its opposite sides for the passage of threaded rods 40 affixed to, and extending rearwardly from pegs 22–28. At one end of plate 20 are holes 42 and 44 having diameters sufficient to snugly yet rotatably accommodate threaded rods 40 extending from pegs 22 and 24. At the other end of plate 20, however, are slots 46 and 48 that permit rods extending from pegs 26 and 28 to slide toward holes 42 and 44 or away from holes 42 and 44. It will be noted that the distance between hole 42 and slot 46 is greater than the distance between hole 44 and slot 48 so as to accommodate the particular outline of violin 32, but such relationships can be varied to suit the peculiarities of different instruments. Nonetheless, by selectively loosening nuts 50 threaded upon the free ends of rods 40 to engage the back of plate 20, pegs 22–28 can be moved by a user to engage violin 32.

Figure 1:
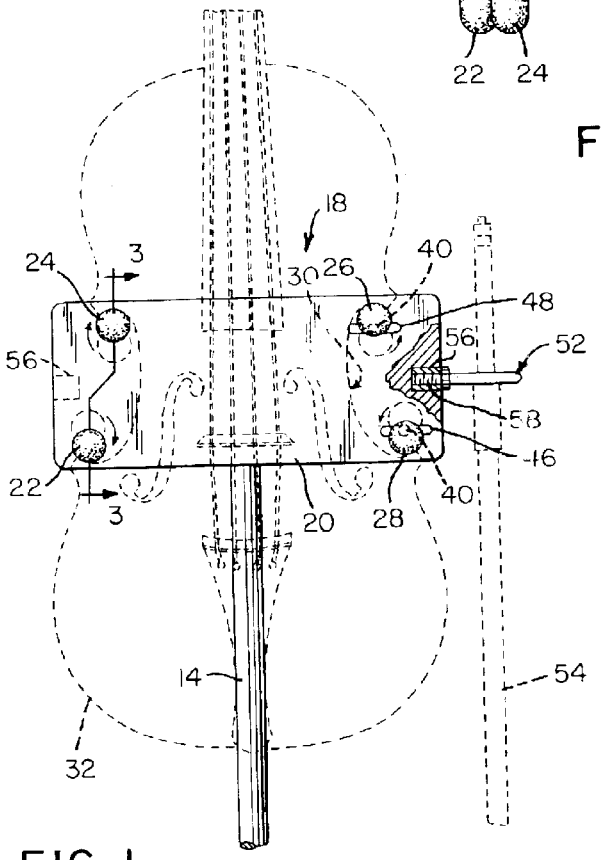
FIG. 1 is a front view of the upper, clamping portion of a violin stand in accordance with the present invention.
Figure 3:
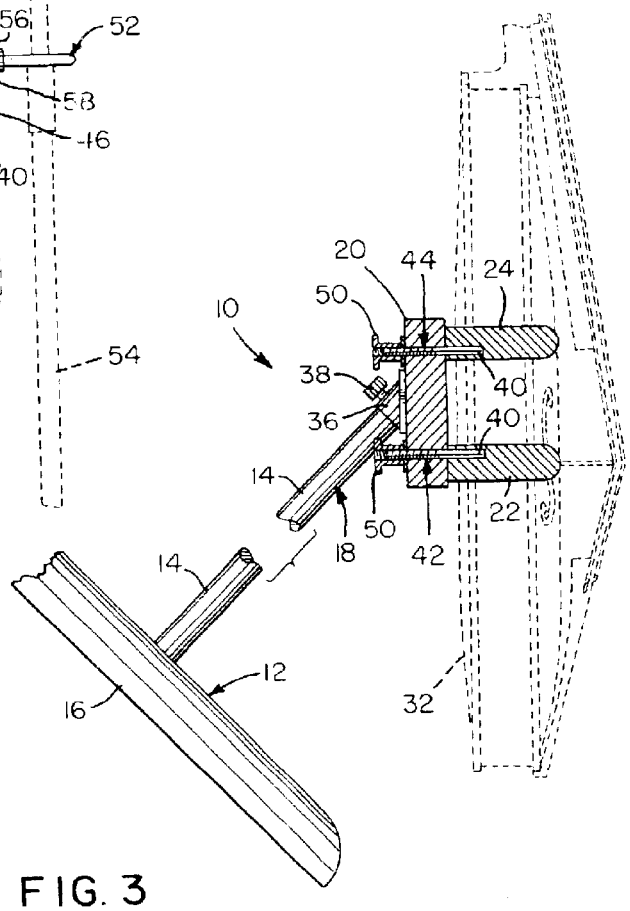
FIG. 3 is a cross-sectional view taken along line 3—3 of FIG. 1 and including the lower portion of the violin stand.

Threaded rods 40 penetrate pegs 22–28 at points close to the sides of pegs 22–28 and remote from the centers of pegs 22–28. The off-centered positioning of threaded rods 40 permits pegs 22–28, which have round cross sections, to act as cams to selectively clamp violin 32 when rotated into engagement therewith. Thus, as shown in FIG. 1, pegs 22–28 can be rotated from the positions illustrated by broken lines to those illustrated by solid lines to push both upwardly and downwardly upon the center bout 30 of violin 32 to hold violin 32 firmly in place within clamping portion 18.

A bow peg 52 extends horizontally from support plate 20 for carrying a violin bow 54. To carry bow peg 52, a pair of internally threaded sockets 56 are provided to support plate 20, each being embedded in one of the opposite ends of support plate 20. Bow peg 52 has a threaded end 58 for threaded engagement with either of the sockets 56. So, bow peg 52 can be moved to either side of support plate 20 to retain violin bow 54 in a position that is readily accessible to right- and left-handed users.

Use of violin stand 10 is straightforward. First, nuts 50 are loosened and pegs 22–28 are rotated so that the largest segments thereof point toward the nearest end of plate 20 or toward one another as illustrated by the broken line positionings in FIG. 1. Next, with base 16 positioned on the ground, the back of violin 32 is positioned adjacent plate 20 with pegs 22–28 in center bout 30. Then, pegs 22 and 24 are rotated into a light engagement with violin 32 and associated nuts 50 are tightened to fix the positions of pegs 22 and 24. Now, pegs 26 and 28 are slid along slots 46 and 48 and rotated so that they mirror the positions of pegs 22 and 24. After that, nuts 50 associated with pegs 26 and 28 are tightened to set the positions of pegs 26 and 28. Finally, bow peg 52 is threaded into either of sockets 56 and bow 54 is hung thereon. Violin 32 and bow 54 can now be removed from stand 10 when desired, used, and returned to stand 10 without further adjustment of stand 10.

Violin stand 10 with its movable pegs 22–28 is believed to be an effective means of supporting violins of various sizes in a ready-to-play position. Interestingly, by removing supporting portion 12 from stand 10, clamping portion 18 can be used alone. With nuts 50 positioned on a table or other horizontal surface, clamping portion 18 will retain violin in a face-up position for adjustment and repair. Thus, it will be appreciated that stand 10 is highly versatile, serving a variety of needs.

While the invention has been described with a high degree of particularity, it will be appreciated by those skilled in the art that modifications may be made thereto. For example, pivoting mechanisms could be substituted for bracket 34 to permit support plate 20 to move about either a horizontal or vertical axis to accommodate finicky users. Also, plate 20 and pegs 22–28 can be provided with a variety of coatings like felt or foam rubber to inhibit the marring of violin 32. Therefore, it is to be understood that the present invention is not limited to the sole embodiment described above, but encompasses any and all embodiments within the scope of the following claims.

I claim:

1. A violin stand, comprising:

a ground-engaging base;

a post extending upwardly from said ground-engaging base;

a support plate mounted atop said post, said support plate including at least one hole and at least one slot remote from said hole;

a plurality of threaded rods, one of said threaded rods extending through each said hole and each said slot and extending from the front and the back of said support plate;

a plurality of pegs extending forwardly from the front of said support plate, one of said pegs being affixed to each of said threaded rods in an off-centered manner such that said pegs act as cams when rotated with said threaded rods; and, a plurality of nuts extending rearwardly from the back of said support plate, one of said nuts being threadably fastened to each of said threaded rods.

2. The violin stand according to claim 1 wherein said support plate is provided with a threaded socket in one end thereof and said violin stand further comprises a bow peg threadably engaged with said threaded socket.

3. A violin stand, comprising:

a ground-engaging base;

a post extending upwardly from said ground-engaging base;

a support plate mounted atop said post, said support plate including a pair of vertically disposed holes and a pair of vertically disposed slots adjacent said holes;

a plurality of threaded rods, one of said threaded rods extending through each of said holes and each said slots and extending from the front and the back of said support plate;

a plurality of pegs extending forwardly from the front of said support plate, one of said pegs being affixed to each of said threaded rods in an off-centered manner such that said pegs act as cams when rotated with said threaded rods; and, a plurality of nuts extending rearwardly from the back of said support plate, one of said nuts being threadably fastened to each of said threaded rods.

4. The violin stand according to claim 1 wherein said support plate is provided with a pair of threaded sockets each of which being disposed in one of the opposed ends of said support plate and said violin stand further comprises a bow peg selectively threadably engaged with one of said threaded sockets.

5. A violin stand, comprising:

a support plate including at least one hole and at least one slot remote from said hole;

a plurality of threaded rods, one of said threaded rods extending through each said hole and each said slot and extending from the front and the back of said support plate;

a plurality of pegs extending from the front of said support plate, one of said pegs being affixed to each of said threaded rods in an off-centered manner such that said pegs act as cams when rotated with said threaded rods; and, a plurality of nuts extending from the back of said support plate, one of said nuts being threadably fastened to each of said threaded rods.

* * * * *